US009105390B2

(12) United States Patent
Yang

(10) Patent No.: US 9,105,390 B2
(45) Date of Patent: Aug. 11, 2015

(54) STRUCTURE OF TRANSFORMER

(71) Applicant: Sen-Tai Yang, New Taipei (TW)

(72) Inventor: Sen-Tai Yang, New Taipei (TW)

(73) Assignee: Yujing Technology Co., Ltd., New Taipei (TW)

( * ) Notice: Subject to any disclaimer, the term of this patent is extended or adjusted under 35 U.S.C. 154(b) by 0 days.

(21) Appl. No.: 14/206,165

(22) Filed: Mar. 12, 2014

(65) Prior Publication Data

US 2014/0266528 A1 Sep. 18, 2014

(30) Foreign Application Priority Data

Mar. 13, 2013 (TW) ..... 102108769 A

(51) Int. Cl.

| | |
|---|---|
| ***H01F 27/30*** | (2006.01) |
| ***H01F 27/28*** | (2006.01) |
| ***H01F 27/29*** | (2006.01) |
| ***H01F 27/26*** | (2006.01) |
| ***H01F 27/24*** | (2006.01) |

(52) U.S. Cl.

CPC ..... *H01F 27/24* (2013.01); *H01F 27/2866* (2013.01); *H01F 27/306* (2013.01)

(58) Field of Classification Search

CPC ..... H01F 27/28; H01F 27/29; H01F 27/30; H01F 27/26

USPC ..... 336/180, 193, 198, 210, 223, 225, 192

See application file for complete search history.

(56) References Cited

U.S. PATENT DOCUMENTS

| | | | | |
|---|---|---|---|---|
| 4,176,335 | A * | 11/1979 | Charpentier | 336/180 |
| 5,748,064 | A * | 5/1998 | Smeenge et al. | 336/83 |
| 7,180,398 | B2 * | 2/2007 | Hoffmann et al. | 336/208 |
| 2007/0057757 | A1 * | 3/2007 | Chen et al. | 336/212 |
| 2008/0055033 | A1 * | 3/2008 | Cheng et al. | 336/83 |
| 2009/0108979 | A1 * | 4/2009 | Kosugi et al. | 336/208 |
| 2009/0309686 | A1 * | 12/2009 | Espino | 336/182 |

FOREIGN PATENT DOCUMENTS

GB 864046 A * 3/1961

* cited by examiner

*Primary Examiner* — Tsz Chan
(74) *Attorney, Agent, or Firm* — Pro-Techtor Int'l Services

(57) ABSTRACT

An improved structure of transformer includes a lead frame main body (1), a lead frame cover (2), a trouser-like flap (3), and two iron cores (4) where the lead frame main body (1) has a penetration hole (11) with a bobbin (12) formed at the circumference there around. The trouser-like flap (3) being made of metal has a hollow part (31) for slipping on a bobbin (121) of the lead frame main body (1) also includes horizontally stretched thigh parts (32), (33). The outer circumference of the trouser-like flap (3) is furnished with a primary winding (123). The lead frame cover (2) being a sheet-shaped body has a hollow hole (21) furnished at the center thereof. On the inner-side surface, each of the two iron core (4) has a main core part (41) capable of stretching through the penetration hole (11) of the lead frame main body (1) where the main core part (41) has a containing circumferential trench (43) capable of containing the lead frame main body (1). What is more, the containing circumferential trench (43) also has a pair of oppositely disposed side openings (44), (45) for being stretched through by the wire connecting seats (13), (14).

2 Claims, 7 Drawing Sheets

STRUCTURE OF TRANSFORMER

BACKGROUND OF THE INVENTION

1. Field of the Invention

The invention relates to an improved structure of transformer, and more particularly, to an improved structure of transformer making use of a trouser-like flap furnished by fitting to the main core part of the iron core to form the transformer's secondary winding.

2. Description of the Prior Art

Most of the transformers of the prior art are coil type transformer which employs two wires (enamel covered wire) to wind around a same iron core forming a primary winding to be connected to a power source and a secondary winding to be connected to a load. The relation for generating induction voltage depends on the secondary-to-primary-turn ratio. When it comes to changing the output voltage of the coil type transformer, at least the number of turn of the coil needs to be changed in the design of the corresponding single manufacturing process in light of each kind of transformer's specifications making it inconvenience in production, complication in the process of the winding process of the coil, relatively high in manufacturing cost, thereby resulting in uneconomical effect.

What is more, in light of the requirements of the characteristic of low voltage and high current, and since the coil of the secondary winding has to use a conduction wire (enamel covered wire) having relatively larger diameter, the gap formed between each turn of wire of the coil will be relatively larger making the fact that the volume of the overall transformer appear irrationally increase and causing the increase of eddy current loss. This is a demerit of the transformers of the prior art in application.

FIG. 1 is an isometric exploded view of the structure the transformer employing metal strips to be a secondary winding of the prior art while FIG. 2 is an outward appearance of the assembled structure the transformer of the prior art. For the sake of satisfying the requirements of constantly increasing the output current of the secondary winding, and saving the wire winding space, another transformer structure of the prior art was provided as shown in FIG. 1, and FIG. 2. The transformer structure of the prior art mainly includes a lead frame (9), two oppositely combined iron cores (7), and a plurality of thin metal strips (8), each of them with a thickness of 10 μm~100 μm. Each of the metal strips (8) has a main core part (71) and four side wing parts (72) with side openings (74) provided in between thereof. A containing space (73), formed between the main core part (71) and the four side wing parts (72), is outwardly communicative through the four side openings (74). The lead frame (9) having a penetration hole (91) furnished at the center thereof for slipping on the main core part (71) is contained in the containing space (73) of the iron core (7). The lead frame (9) also has a bobbin furnished at the mid-section of the outer circumference thereof for the primary winding (92) (coil) to be wound with a positioning part (931) defined by upper-and-lower partitioned plates (93) that has a wire connecting seats (94) furnished at an end corner thereof and capable of stretching out of the iron core (7) through the side openings (74). At each of the wire connecting seats (94), there is at least a wire connecting posts (941) connected to the primary winding (92). Each of the metal strips (8) has a hollow part (81) that is furnished at the center thereof, and is capable of slipping on the positioning parts (931) making all of the metal strips (8) axially stack up. Moreover, each of the metal strips (8) has an opening gap (82) at a corner thereof having extended polar legs (83) capable of stretching out of the iron core (7) through the side opening (74). When it comes to assembling, a plurality of partitioning metal strips (84) are placed in between the metal strips (8) making each of the metal strip (8) form a secondary winding. This kind of stacking up metal strips (8) and partitioning metal strips (84) is capable of lowering the eddy current loss in practical application. However, it will result in having relatively larger overall induction loss.

FIG. 3 is an isometric exploded view of another structure the transformer employing metal strips to be a secondary winding of the prior art while FIG. 4 is an outward appearance of the assembled structure the transformer shown in FIG. 3 of the prior art. Further another transformer structure of the prior art was provided as shown in FIG. 3, and FIG. 4, The transformer structure of the prior art mainly includes a lead frame (90), a plurality of metal strips (80) having thickness from tens of mini meters to hundreds of mini meters, and a pair of oppositely combined E-shaped iron cores (70). The lead frame (90) has a transversely stretching penetration hole (901) with a plurality of slots (902) furnished at the periphery thereof for providing a primary winding (903) (coil). The lead frame (90) has wire connecting seats (904) formed at both ends of the penetration hole (901) where one of the wire connecting seats (904) has wire connecting posts (905) connected to both ends of the primary winding (903). The metal strips (80) being in inverse U-shape are arranged in the direction parallel to the axis of the penetration hole (901) to cover all the plurality of slots (902) at the outer circumference { the primary winding (903) may be wound around the outer circumference of the metal strips (80) } so as to form a sandwich winding and form polar legs (801) stretched in the same direction as those of the wire connecting posts (905) at both ends of the metal strips (80). When it comes to assembling, a cap (802) having an appropriate containing space (803) and a pair of side penetration holes (804) corresponding to the penetration hole (901) is employed to cover the lead frame (90) and the metal strips (80). Afterward, the pair of oppositely combined E-shaped iron cores (70) has their central main core parts stretch through both of the side penetration holes (804) respectively of the cape (802) to be contacted each other so as to form another transformer making use of the metal strips (80) to be a secondary winding. As this kind of structure having each of the metal strips (80) furnished in the direction of the main core part of the E-shaped iron cores (70) is capable of effectively diminishing induction loss. Moreover, since the metal strips (80) having the characteristic of not being bendable with structural products appeared in horizontally rather than vertically stacking up has seriously affected the diversity and competitiveness of transformer product.

SUMMARY OF THE INVENTION

In light of the above-mentioned disadvantages of the prior art, the invention provides an improved structure of transformer that is capable of overcoming the shortcomings of the prior art, satisfying the requirements of the industry, as well as improving the competitiveness in the market. It aims to ameliorate at least some of the disadvantages of the prior art or to provide a useful alternative.

The primary objective of the invention is to provide an improved structure of transformer making use of the convenience of a design of a removable and separable lead frame cover to provide a secondary winding formed by trouser-like flap to be assembled in a lead frame main body so as to form a trouser-like flap furnished by fitting to the main core part of the iron core where the main core part of the iron core is an uprightly stretching transformer structure to achieve the diversity and competitiveness of transformer product.

The secondary objective of the invention is to provide an improved structure of transformer by making use of a secondary winding design of an integrally formed trouser-like flap that is capable of effectively simplifying the manufacturing process and lowing production cost.

To achieve the above-mentioned objectives and efficacies, an improved structure of transformer is provided to include a lead frame main to body, a lead frame cover, a trouser-like flap, and two iron cores where the lead frame main body has a penetration hole with a bobbin formed at the circumference there around. The trouser-like flap being made of metal has a hollow part for slipping on a bobbin of the lead frame main body also includes horizontally stretched thigh parts. The outer circumference of the trouser-like flap is furnished with a primary winding. The lead frame cover being a sheet-shaped body has a hollow hole furnished at the center thereof, and on the inner-side surface, each of the two iron core has a main core part capable of stretching through the penetration hole of the lead frame main body where the main core part has a containing circumferential trench capable of containing the lead frame main body, wherein the containing circumferential trench also has a pair of oppositely disposed side openings for being stretched through by the wire connecting seats.

In accordance with the above-mentioned structure, a primary winding is furnished around the outer circumference of the trouser-like flap.

In accordance with the above-mentioned structure, the primary winding is wound by enamel covered wire.

In accordance with the above-mentioned structure, two breaches are furnished at the wire connecting seat, and the trouser-like flap also includes horizontally stretched thigh parts having wire connecting legs stretched in the axial direction of the trouser-like flap and through the breaches.

In accordance with the above-mentioned structure, the wire connecting seat has a plurality of primary winding conducting post while the wire connecting seats has a plurality of spare conductance posts, and the two end parts of the primary winding are connected to the primary winding conducting post.

In accordance with the above-mentioned structure, two oppositely disposed combining part are furnished at the circumference of the bobbin of the lead frame main body while the inner circumference of the hollow hole of the lead frame cover has at least two to-be-combined parts corresponding to the combining parts to make the lead frame cover and lead frame main body form secure combination.

In accordance with the above-mentioned structure, the combining parts are hook parts while the to-be-combined parts are adverse hook parts.

In accordance with the above-mentioned structure, the lead frame main body has a plurality of fillet and rounds furnished and for being stopped at the circumference of the bobbin at the side of the circumference of the lead frame cover.

In accordance with the above-mentioned structure, a pair of oppositely disposed clip-receiving recesses furnished on the outer-side surface of the iron cores are provided for being clipped by a pair of clip fasteners making the two iron cores maintain a secure combination.

In accordance with the above-mentioned structure, a plurality of partitioned clip slots of lead frame cover are furnished to correspond to the two edges of the wire connecting seats of the lead frame main body.

The accomplishment of this and other objectives of the invention will become apparent from the following description and its accompanying drawings of which:

DETAILED DESCRIPTION OF THE PREFERRED EMBODIMENT

Figure 1:
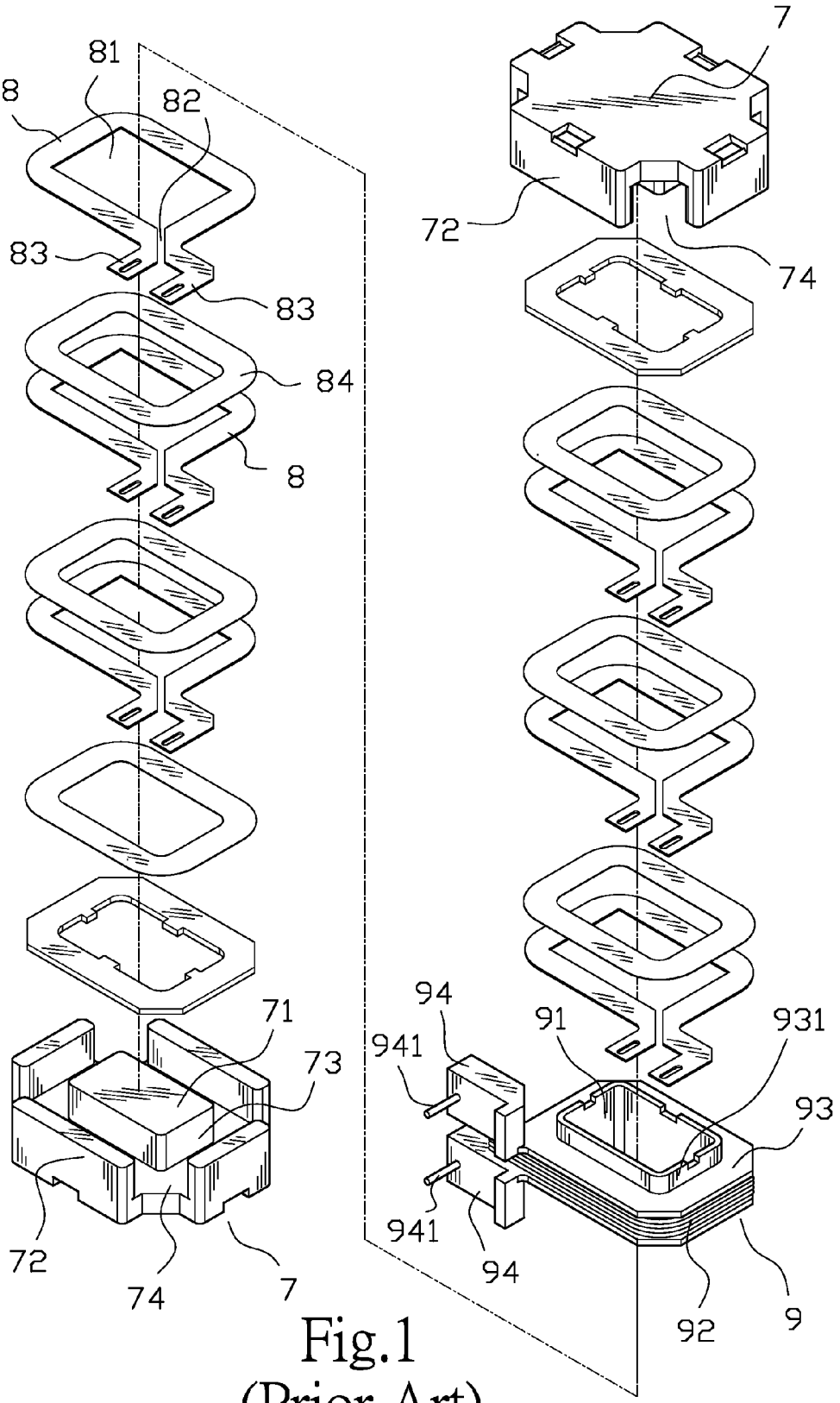
Fig.1 (Prior Art)
FIG. 1 is an isometric exploded view of the structure the transformer employing metal strips to be a secondary winding of the prior art.
Figure 2:
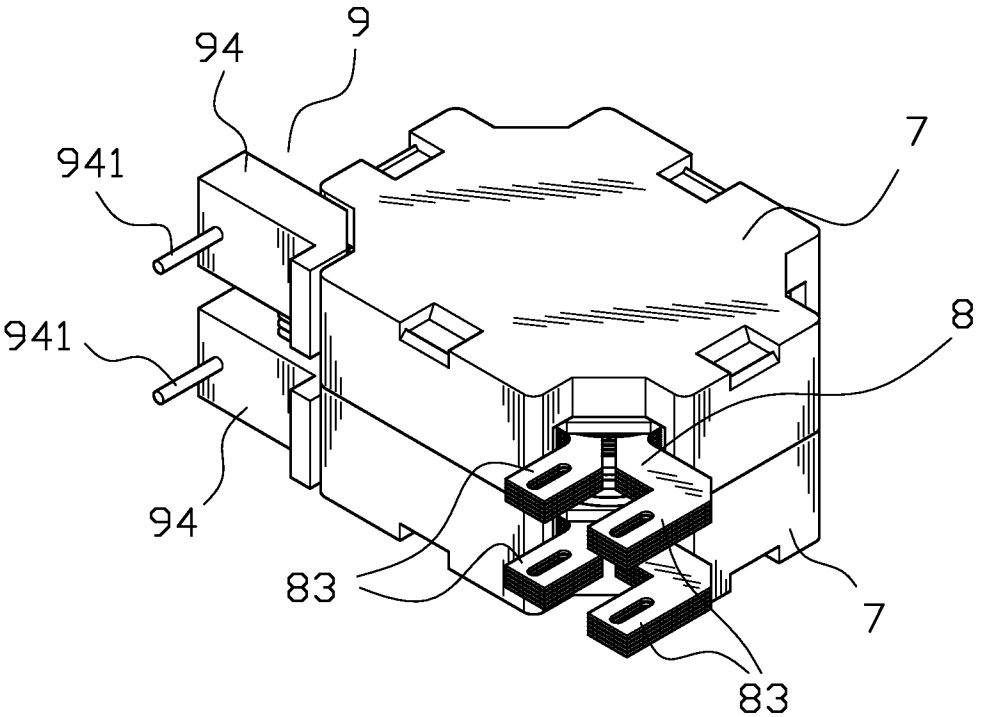
Fig.2 (Prior Art)
FIG. 2 is an outward appearance of the assembled structure the transformer of the prior art.
Figure 3:
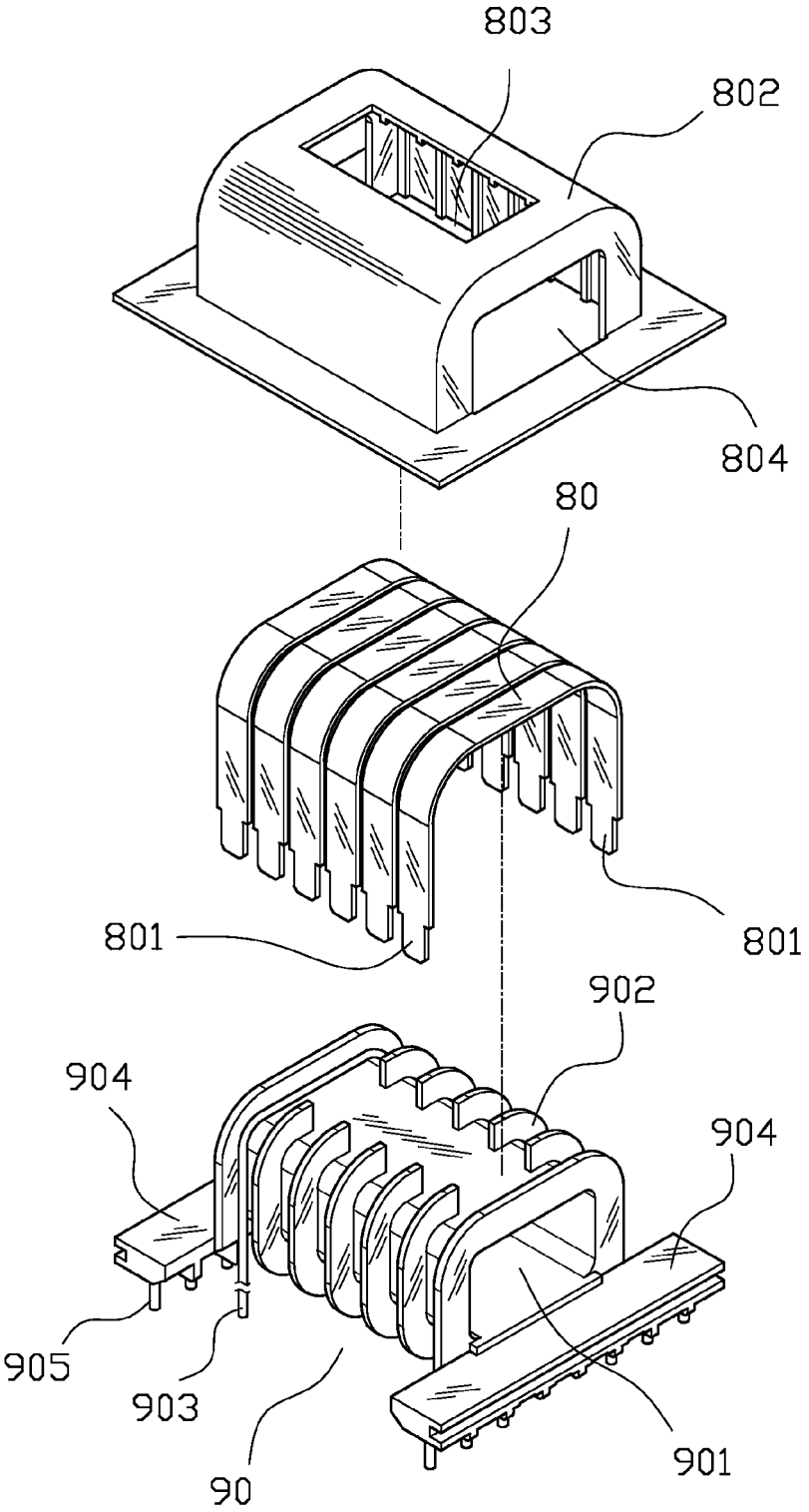
Fig.3 (Prior Art)
FIG. 3 is an isometric exploded view of another structure the transformer employing metal strips to be a secondary winding of the prior art.
Figure 4:
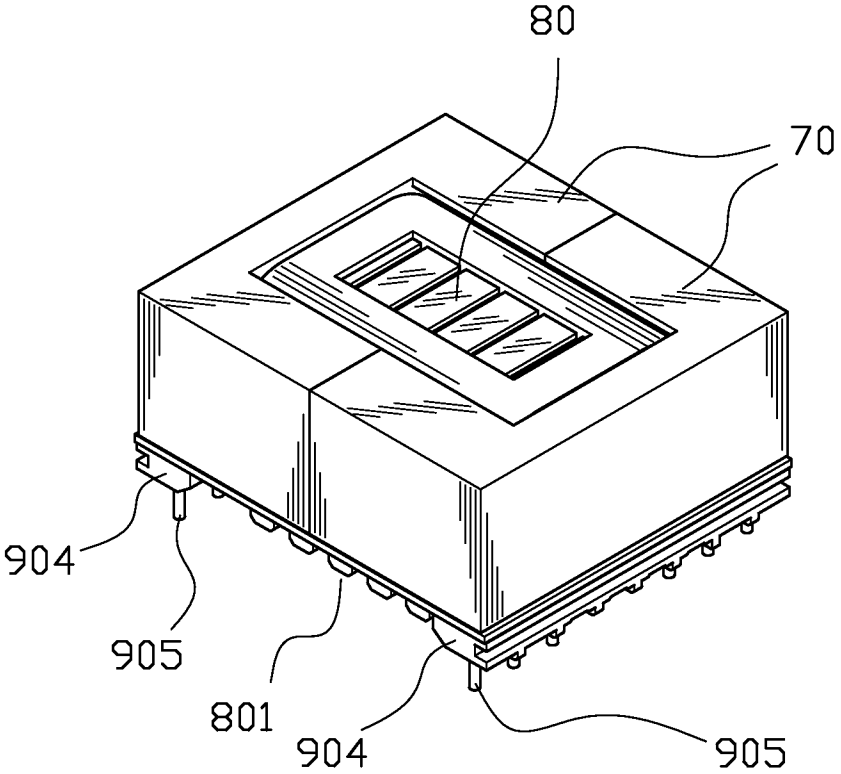
Fig.4 (Prior Art)
FIG. 4 is an outward appearance of the assembled structure the transformer shown in FIG. 3 of the prior art.
Figure 5:
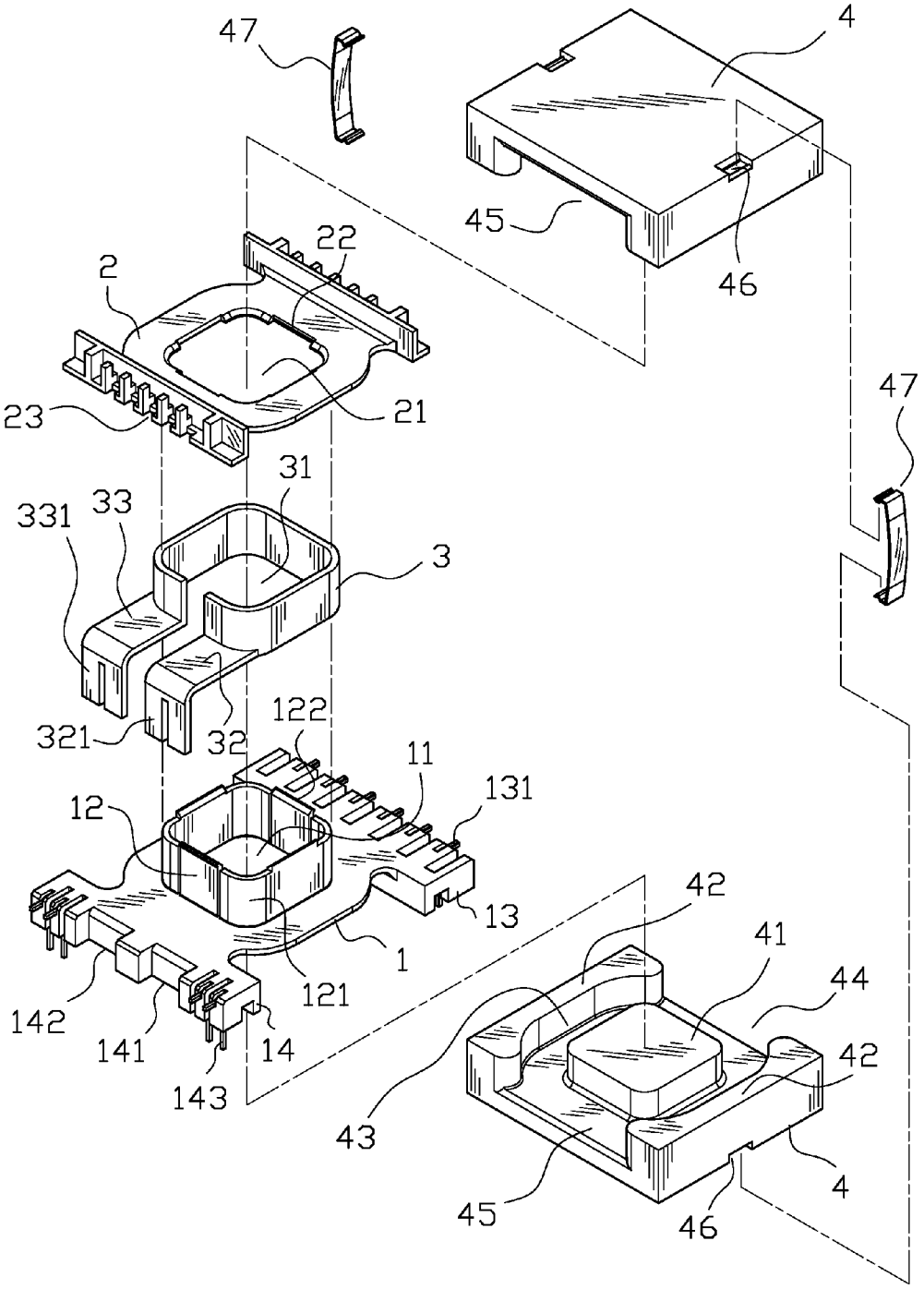
FIG. 5 is an isometric exploded view of the improved structure the transformer of the invention.

FIG. 5 is an isometric exploded view of the improved structure the transformer of the invention. As shown in FIG. 5, the improved structure the transformer of the invention includes a lead frame main body (1), a lead frame cover (2), a trouser-like flap (3), and two iron cores (4). The lead frame main body (1) is a tube body having a penetration hole (11) with a bobbin (12) formed at the circumference there around where the four corners of the bobbin (12) are fillet and rounds (121). The lead frame main body (I) has two oppositely disposed wire connecting seats (13), (14) where the wire connecting seat (13) has a plurality of primary winding conducting post (131) while the wire connecting seats (14) has a plurality of spare conductance posts (143) and two breaches (141), (142) furnished thereof. Moreover, two oppositely disposed combining parts (122) which can also be hook parts are furnished at the circumference of the bobbin (12) of the lead frame main body (1).

The trouser-like flap (3) being made of metal has a hollow part (31) for slipping on a bobbin (121) of the lead frame main body (I). The trouser-like flap (3) also includes horizontally stretched thigh parts (32), (33) having wire connecting legs (321), (331) stretched in the axial direction of the trouser-like flap (3).

The lead frame cover (2) being a sheet-shaped body has a hollow hole (21) furnished at the center thereof and is corresponding to the penetration hole (11) where the inner circumference of the hollow hole (21) has at least two to-be-combined parts (22) (which can also be adverse hook parts) corresponding to the combining parts (122) (which can also be hook parts). Moreover, the lead frame cover (2) has a plurality of clip slots (23) furnished on the two side edges that are corresponding to the wire connecting seats (13), (14) of the lead frame main body (1).

On the inner-side surface, the iron core (4) has a main core part (41) capable of stretching through the penetration hole (11) of the lead frame main body (1) where the main core part (41) has a pair of oppositely disposed side wing parts (42) furnished on the outer edge thereof, and also has a containing circumferential trench (43) capable of containing the lead frame main body (1) and formed between the main core part (41) and the side wing part (42). What is more, the containing circumferential trench (43) also has a pair of oppositely disposed side openings (44), (45). In addition, on the outer-side surface, the iron core (4) has a pair of oppositely disposed clip-receiving recesses (46).

Figure 6:
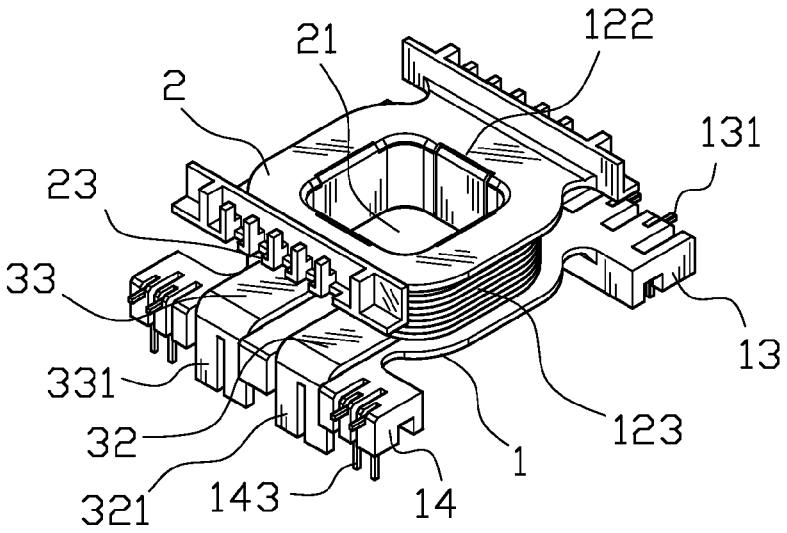
FIG. 6 is an isometric view of the assembled structure of the lead frame and the coil of the improved structure of transformer of the invention.
Figure 8:
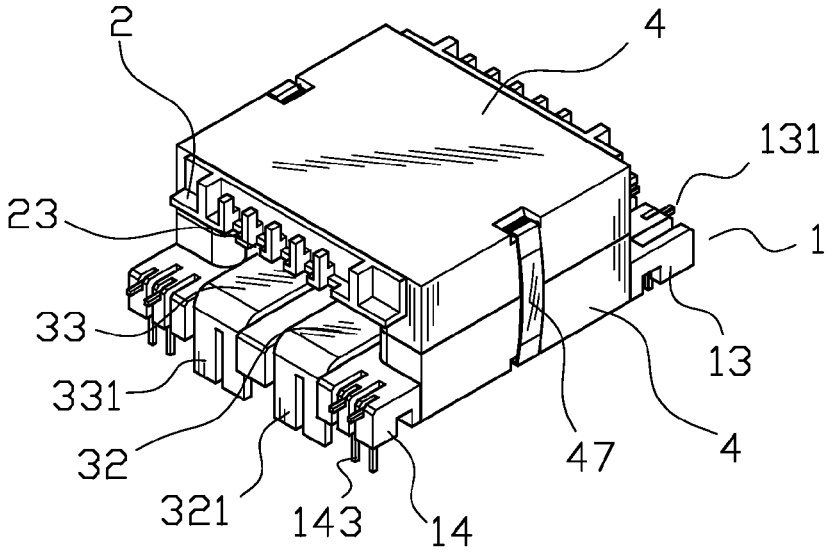
FIG. 8 is an isometric view of an outward appearance of the overall assembled structure of the improved structure of transformer of the invention.
Figure 7:
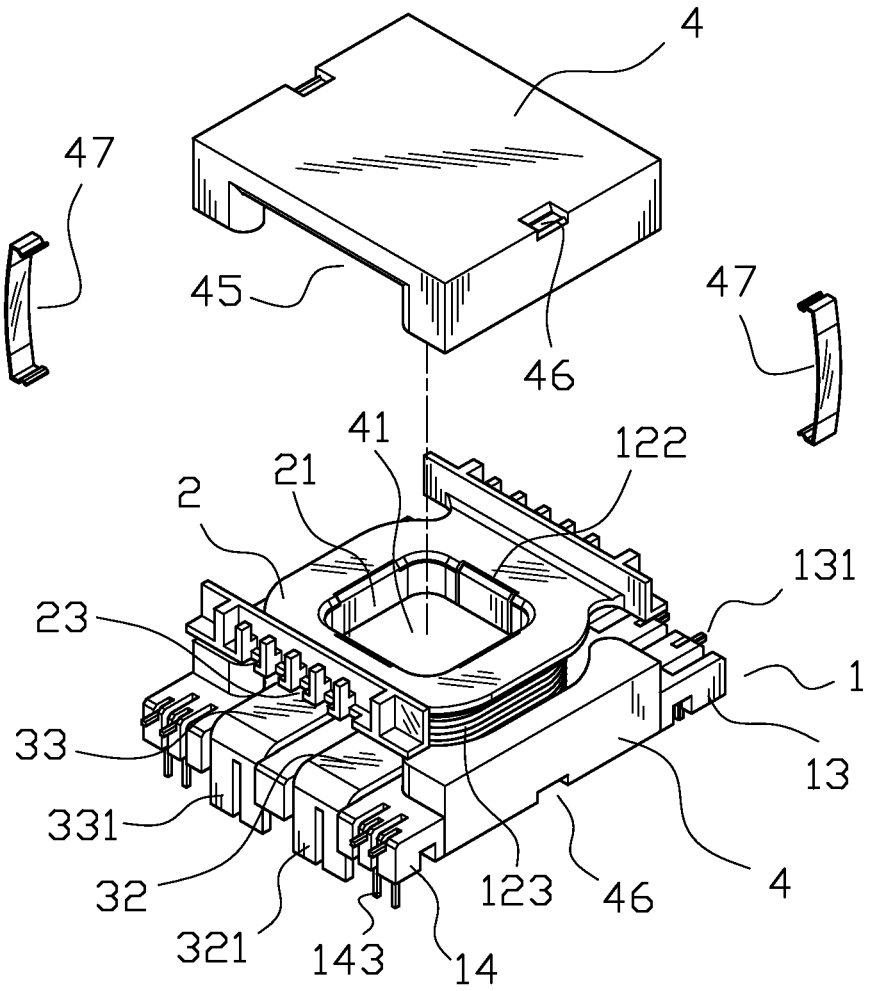
FIG. 7 is an isometric view of a part of the assembled structure of the improved structure of transformer of the invention.

FIG. 6 is an isometric view of the assembled structure of the lead frame and the coil of the improved structure of transformer of the invention; FIG. 7 is an isometric view of a part of the assembled structure of the improved structure of transformer of the invention; while FIG. 8 is an isometric view of an outward appearance of the overall assembled structure of the improved structure of transformer of the invention. As shown in FIG. 6, FIG. 7, and FIG. 8, when it comes to assembling, the hollow part (31) of the trouser-like flap (3) is slipped on the circumference of the bobbin (12) of the lead frame main body (1), and in the mean time, the wire-connecting ends (321), (331) are stretched through the breaches (141), (142) toward the same directions of the second pivotally-connected part (241) and primary winding conducting post (131) respectively. Afterward, the lead frame cover (2) is covered on the lead frame main body (1) with the combining parts (122) (hook parts) hooked to the to-be-combined parts (22) (can be adverse hook parts) to make the lead frame cover (2) and lead frame main body (1) not only form secure combination but also limit the trouser-like flap (3) from being come off. Thereafter, the outer circumference of the trouser-like flap (3) is wound to form a primary winding (123) by employing enamel covered wire, and is additionally wound to form a control winding (not shown in the Figure) as it is required making both end parts of both the primary winding (123) and the control winding being embedded into various clip slots (23) respectively to form temporary positioning. Thereafter, The main core part (41) is stretched through the penetration hole (11) of the lead frame main body (1) making the top-and-bottom iron core (4) contact together. In the mean time, the wire connecting seats (13), (14) of the lead frame main body (1) are stretched outward through the side openings (44), (45) respectively, and by employing the clip fastener (47) to clip the top-and bottom iron cores (4) together in secure combination condition by having the clip fastener (47) fasten in the clip-receiving recesses (46). Lastly, the overall assembly of the transformer is achieved by having the two end parts of the primary winding (123) be brazed with the primary winding conducting post (131) and the two end parts of the control winding be brazed with the each of the spare conductance posts (143).

In conclusion, the design of employing the trouser-like flap (3) to cover the bobbin (12) and the main core part (41) of the iron core (4) of the improved structure of the invention is capable of effectively lowering the penetration area of magnetic leakage, diminishing Eddy current loss, and lowering the copper loss, and further achieving the efficacy of carried direct current.

In accordance with the above-mentioned description, the improved structure of transformer of the invention is capable of surely simplifying its structure and assembling process, and producing a transformer having the efficacy of transformer with secondary winding of the trouser-like flap (3) that is covered in the direction of the main core part (41) of the iron core (4), making the improved structure of transformer of the invention meet the conditions of patentability.

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. An improved structure of transformer, comprising a lead frame main body (1) being a tube body has a penetration hole (11) furnished at the center thereof, and a bobbin (12) formed at the circumference there around, and has two oppositely disposed wire connecting seats (13), (14);

a trouser-like flap (3) being made of metal has a hollow part (31) for slipping on a bobbin (121) of the lead frame main body (1) has horizontally stretched thigh parts (32), (33);

a lead frame cover (2) being a sheet-shaped body has a hollow hole (21) furnished at the center thereof and is corresponding to the penetration hole (11); and two iron cores (4) having a main core part (41) capable of stretching through the penetration hole (11) of the lead frame main body (1) where the main (41) has a sitely side wing parts (42) furnished on the outer edge thereof, and also has a containing circumferential trench (43) capable of containing the lead frame main body (1) and formed between the main core part (41) and the side wing part containing circumferential trench (43) also has a pair of oppositely disposed side openings (44), (45), wherein two breaches (141), (142) are furnished at the wire connecting seat (14), and the trouser-like flap (3) also includes horizontally stretched thigh parts (32), (33) having wire connecting legs (321), (331) stretched in the axial direction of the trouser-like flap (3) and through the breaches (141), (142).

2. The improved structure of transformer as claimed in claim 1, wherein the wire connecting seat (13) has a plurality of primary winding conducting post (131) while the wire connecting seats (14) has a plurality of spare conductance posts (143), and the two end parts of the primary winding (123) are connected to the primary winding conducting post (131).

* * * * *